United States Patent [19]

Santén et al.

[11] Patent Number: 4,917,763

[45] Date of Patent: Apr. 17, 1990

[54] METHOD OF RECOVERING CHEMICAL FROM SPENT PULP LIQUORS

[75] Inventors: Sven Santén, Hofors; Ragnar Bernhard, Falun; Jarl Martensson, Sandviken, all of Sweden

[73] Assignee: SKF Steel Engineering AB, Hofors, Sweden

[21] Appl. No.: 205,604

[22] Filed: Jun. 10, 1988

Related U.S. Application Data

[63] Continuation of Ser. No. 784,007, Oct. 4, 1985, abandoned.

[30] Foreign Application Priority Data

Oct. 19, 1984 [SE] Sweden ..... 8405231

[51] Int. Cl.[4] ..... D21C 11/14

[52] U.S. Cl. ..... 162/30.1; 162/30.11; 162/31; 423/DIG. 10; 422/185; 110/165 R; 110/259

[58] Field of Search ..... 162/30.1, 30.11, 31; 423/DIG. 10; 422/185; 110/259, 165 R

[56] References Cited

U.S. PATENT DOCUMENTS 3,163,495 12/1964 Greenawalt ..... 422/185 X
3,323,858 6/1967 Guerrieri ..... 162/30.11 X
4,601,786 7/1986 Santén et al. ..... 162/30.1

FOREIGN PATENT DOCUMENTS 7709416-8 7/1977 Sweden .
8101701-4 3/1981 Sweden .
2138458 10/1984 United Kingdom .

*Primary Examiner*—Peter Chin
*Assistant Examiner*—Thi Dang
*Attorney, Agent, or Firm*—Armstrong, Nikaido, Marmelstein, Kubovcik & Murray

[57] ABSTRACT

The present invention relates to a method of recovering chemicals from spent liquors while at the same time utilizing energy liberated during the process. The spent liquors are gasified and partially disintegrated in a reactor (1), external thermal energy independent of combustion being simultaneously supplied to the reaction zone (2) of the reactor, after which the resultant melt is separated (at 9) at substantially the temperature prevailing at combustion, the gaseous product thereby formed being quenched in a quenching and cooling zone (6), to a temperature below 950° C. A product gas is thus obtained which contains substantially no sulphur impurities, an alkali product with high sulphide content and an alkali product substantially free from sulphide and having low $Na_2CO_3$ content.

5 Claims, 1 Drawing Sheet

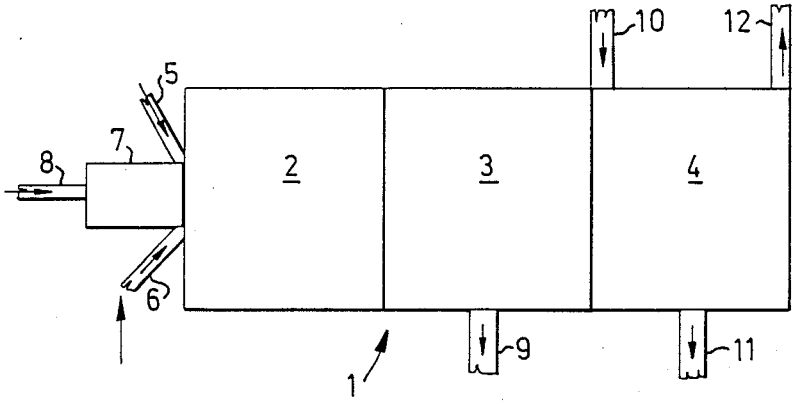
10
12
5
7
8
2
3
4
6
9
11
1

METHOD OF RECOVERING CHEMICAL FROM SPENT PULP LIQUORS

This application is a continuation of application Ser. No. 784,007 filed Oct. 4, 1985 now abandoned.

The present invention relates to a method of recovering chemicals from spent pulp liquors while at the same time utilizing energy liberated during the process.

A process of the type mentioned in the introduction is already known in which the inorganic constituents are withdrawn primarily in the form of a melt or water solution and the organic part is withdrawn in the form of a gas containing primarily $H_2$ and CO. The spent pulp liquors are supplied to a reactor for gasification and partial disintegration, together with external thermal energy independent of combustion, after which the product thereby formed is quenched and allowed to cool in the quenching and cooling zone included in the reactor. Temperature and oxygen potential are controlled independently of each other in the process, by the regulated supply of thermal energy and the possible addition of carbonaceous material and/or oxygen-containing gas.

The external supply of energy to the reaction zone of the reactor ensures a high temperature at low oxygen potential and endeavours are made to ensure that the sodium content exists primarily in the form of a single-atom gas. Due to the carefully regulated oxygen potential and the temperature which, according to said process may preferably be achieved by the use of an energy-enriched gas heated in a plasma generator for the supply of external thermal energy, NaOH and $Na_2S$ are the principal chemicals obtained upon cooling, i.e. white liquor chemicals, while the formation of $Na_2CO_3$ is at the same time restrained.

Through temperature control another valuable gas is obtained containing substantially only $H_2$ and CO and which can therefore be used for generating steam, for synthetic gas, etc.

However, this entails certain drawbacks in the final products since they contain such large quantities of sulphur and therefore can in principle only be used for renewed preparation of white liquor chemicals.

Furthermore, the relatively large quantity of sulphur causes the equilibrium to be weighted towards $H_2S$, which is a drawback both from the environmental aspect and also since it causes problems when using this otherwise valuable product gas.

The object of the present invention is to eliminate the above-mentioned drawbacks of the known process and enable recovery of a product gas containing substantially no sulphur compounds and consisting substantially of $H_2$ and CO, an alkali product with high sulphide content and an alkali product substantially free from sulphide and having low $Na_2CO_3$ content.

This is achieved in the method described above by separating the melt resulting from the gasification and partial disintegration of spent pulp liquors introduced together with the external thermal energy independent of combustion, into the reaction zone of a reactor, this separation being performed at substantially the temperature prevailing at gasification the gaseous product then being carried to a quenching and cooling zone where it is quenched to a temperature below 950° C.

The sulphur content is then to be found almost entirely in the separated melt in the form of $Na_2S$ and a substantial reduction in the quantity of sulphur in the subsequent quenching step is thus achieved. This has an extremely favourable effect on the equilibrium and an alkali substantially free from sulphide is obtained, as well as a product gas containing substantially no sulphur impurities.

The temperature in the gasification and combustion step is controlled to preferably at least 1100° C.

The external energy, independent of combustion, is supplied in the form of energy from a plasma generator and the spent liquors are introduced through tuyères having their orifices immediately in front of the plasma generator.

The separation of the melt is thus performed in principle at the combustion temperature and no extra quenching is carried out in advance. The separated melt contains mainly $Na_2S$.

The cooling in the quenching stage is effected to below ca.950° C. and may be performed by indirect cooling, or by water, water solution and/or melt being sprayed in.

According to a preferred embodiment of the invention the cooling is effected by means of a liquid to a temperature so low that the alkali compounds are present in water solution, i.e. to a temperature below 200° C.

The separated alkali consists primarily of NaOH, a small quantity of $Na_2CO_3$ and $Na_2S$, the latter compound giving NaHS in a water solution.

The gas rich in energy, containing primarily $H_2$ and CO, is withdrawn through a gas outlet to be used for generating energy in a steam boiler, for instance. Thanks to the low sulphur content, this gas is also suitable for use as synthesis gas, etc.

A number of competing reactions occur during the quenching process, the four most important ones being:

$$NaOH_{(g)} \rightarrow NaOH_{(1)} \quad (1)$$

$$Na_{(g)} + H_2O_{(g)} \rightarrow NaOH_{(g)} + \tfrac{1}{2}H_{2(g)} \quad (2)$$

$$2NaOH_{(1.g)} + CO_{2(g)} \rightarrow Na_2CO_{3(1)} + H_2O_{(g)} \quad (3)$$

$$2Na_{(g)} + CO_{2(g)} + H_2O_{(g)} \rightarrow Na_2Co_{3(1)} + H_2(g) \quad (4)$$

The object of the quenching is to promote reactions 1 and 2, i.e. to restrain the formation of $Na_2CO_3$.

The invention will be described in more detail with reference to the accompanying drawing which shows schematically a plant for performing the process according to the invention.

The reactor is generally designated 1 and comprises a reaction zone 2, a separating zone 3 and a quenching and cooling zone 4. The spent liquors, possibly together with carbonaceous and/or oxygen-containing material, are introduced through tuyères 5, 6 and the external energy is supplied through a pipe 8 by means of gas heated in a plasma generator 7. Gasification and partial disintegration are performed in the reaction zone. The supply of energy is controlled so that the temperature in the reaction zone is at least 1100° C. Gasification is preferably carried out to such an extent that practically no soda ($Na_2CO_3$) remains. From the equilibrium aspect Na exists in gaseous form both as a single-atom Na gas and as NaOH.

The products obtained in this way are passed to the separating zone 3 of the reactor where the melt is tapped off through an outlet 9. The melt consists primarily of $Na_2S$.

The remaining gaseous product is conducted from the separating zone 3 into the quenching and cooling zone 4 of the reactor, where it is quenched, preferably by means of a liquid introduced through inlet 10, and the liquid product is tapped off through an outlet 11. The quenching in the quenching and cooling zone is controlled so that the temperature is at most ca.950° C., preferably so low that the remaining alkali exists in the form of a water solution, i.e. in the order of below about 200° C.

The energy-enriched gas is withdrawn through a gas outlet 12 and consists primarily of $H_2$ and CO.

To further illustrate the invention, an example is shown below which constitutes the result of a long series of experiments:

EXAMPLE

The spent pulp liquor used for the experiment had a solid content of 67% and the dry substance (DS) had the following composition.

| | |
|---|---|
| C | 35% |
| H | 4% |
| Na | 19% |
| S | 5% |
| O | 37% |

Via the plasma generator 2100 kWh per ton dry substance was supplied to the reactor as external thermal energy, thus ensuring complete gasification of all organic material in the liquor and part of the alkali. The temperature in the reaction zone was maintained at approximately 1300° C. Substantially all sulphur was separated out in the form of $Na_2S_{(1)}$. Thereafter the remaining alkali was separated out in the form of a water solution after quenching. The melt, water solution and gas, obtained had the following compositions:

| | |
|---|---|
| Melt, kg per ton DS | |
| $Na_2S$ | 120 |
| NaOH | 10 |
| $Na_2CO_3$ | 20 |
| Water solution, kg per ton DS | |
| NaOH | 164 |
| NaHS | 1 |
| $Na_2CO_3$ | 24 |

Converted to normal pressure and temperature, the gs contained the following volumes in $m^3$ per ton DS:

| | |
|---|---|
| $CO_2$ | 105 |
| CO | 443 |
| $H_2O$ | 353 |
| $H_2$ | 650 |
| $H_2S$ | 0.3 |

The melt obtained thus contains only 13% $Na_2CO_3$, which should be compared with 25% $Na_2CO_3$ in a product after conventional caustification.

The alkali obtained can therefore with a good margin of safety be used directly for the production of white liquor and the need for both the caustification and the lime sludge burning steps is thus eliminated.

We claim:

1. A method of recovering chemicals from spent pulp liquors, comprising:

(a) gasifying and partially disintegrating a spent pulp liquor containing organic and inorganic constituents in a raction zone of a reactor into which external thermal energy from a plasma generator has been introduced such that the spent pulp liquor is substantially converted to a product mixture consisting essentially of a melt containing mainly sodium sulfide and a gaseous stream containing mainly hydrogen, carbon monoxide, and alkali compounds;

(b) separating, in a separation zone and at substantially the temperature of gasification, the melt from the gaseous stream to recover sodium sulfide;

(c) cooling the gaseous stream from step (b) in a quenching and cooling zone to a temperature below 950° C. such that the alkali compounds are converted to liquid form and hydrogen and carbon monoxide resin as a product substantially free of sulphur compounds; and (d) withdrawing the alkali compounds in liquid form and withdrawing the product gas substantially free of sulphur compounds.

2. A method according to any claim 1, wherein the cooling is effected by means of water, water solution and/or melt being sprayed in, the temperature being reduced to one at which the alkali content is present in liquid form.

3. A method according to claim 1, wherein the cooling is effected by means of water or a water solution, and the temperature being reduced below 200° C.

4. A method according to claim 1, further comprising supplying carbonaceous and/or oxygen-containing material to the reaction zone.

5. A method according to claim 1, wherein the spent liquors and any carbonaceous and/or oxygencontaining material are introduced into the reaction zone of the reactor through tuyeres having their orifices immediately in front of the plasma generator.

* * * * *